United States Patent [19]

Braymer, Jr.

[11] 4,331,233

[45] May 25, 1982

[54] ACTIVATION CLOSURE FOR VIAL

[75] Inventor: George W. Braymer, Jr., Ross Township, Kalamazoo County, Mich.

[73] Assignee: The Upjohn Company, Kalamazoo, Mich.

[21] Appl. No.: 154,684

[22] Filed: May 30, 1980

[51] Int. Cl.[3] ..... B65D 25/08; B65D 81/32

[52] U.S. Cl. ..... 206/221; 215/DIG. 8

[58] Field of Search ..... 206/219, 221; 215/6, 215/247, 354; 128/272

[56] References Cited

U.S. PATENT DOCUMENTS 4,192,428 3/1980 Segmuller ..... 215/354

4,194,640 3/1980 Crankshaw et al. ..... 206/219

*Primary Examiner*—William T. Dixson, Jr.

*Attorney, Agent, or Firm*—Blanchard, Flynn, Thiel, Boutell & Tanis

[57] ABSTRACT

A closure structure for a two-compartment vial having a stopper sealingly seated within the neck opening of the vial, and a cap interconnected between the stopper and the vial neck. The stopper has a cylindrical portion which protrudes outwardly of the vial neck and is surrounded by a resilient sleevelike collet associated with the cap. The collet is mechanically axially interlocked to the stopper and, together with the cylindrical stopper portion, moves into the neck opening when the closure is urged toward the vial to activate the latter. A cammed or tapered relationship exists between the collet and the vial neck which increases the gripping of the stopper by the collet when they are moved into the neck opening.

11 Claims, 4 Drawing Figures

ACTIVATION CLOSURE FOR VIAL

FIELD OF THE INVENTION

This invention relates to an improved activation closure for a two-compartment vial to facilitate activation of the vial while retaining control over the activating stopper.

BACKGROUND OF THE INVENTION

Two-compartment vials in which a lyophilized medication and a solvent are held in complete independence from each other have been in common use for packaging and mixing medications for many years. Such vials are provided with a neck at one end which opens into one of the compartments, and a cap or closure structure is associated with the vial neck. This closure structure must be capable of closing and sealing the vial to prevent contamination of the medication therein. This closure structure must also be easily attached to the vial and capable of efficient and dependable activation when use of the medication is desired, which activation must be accomplished without causing contamination of the medication or of the syringe used for withdrawing it.

In an attempt to accomplish the above objectives, numerous closure structures have been devised which employ a stopper sealingly disposed within the vial neck and partially captivated by a surrounding cap which engages the rim of the vial neck. By depressing the stopper, after release or removal of the cap, the center plug is dislodged from the constriction between the compartments to allow the solvent and medication to be mixed together. This type of closure structure is illustrated in U.S. Pat. No. 4,089,432, owned by the assignee of this application. The closure structure of this latter patent utilizes a sleeve which is associated with the cap and snugly surrounds a protruding portion of the stopper, whereupon this sleeve and protruding portion are both moved into the vial neck during activation, the sleeve portion being joined to a vial mounting ferrule by a frangible connection. However, it is undesirable in some instances to utilize a cap having a frangible connection associated therewith.

In a continuing effort to improve the closure structure associated with such two-compartment vials there has been developed the closure structure disclosed in copending U.S. application Ser. No. 80 740, filed Oct. 1, 1979, now U.S. Pat. No. 4,267,925, also owned by the assignee of this application. This latter application discloses a closure structure wherein the stopper is lockingly engaged to an inner cap sleeve which snugly surrounds the protruding portion of the stopper, which inner cap sleeve is integrally formed with and concentrically surrounded by an outer cap sleeve which lockingly engages the rim on the vial neck. This outer cap sleeve, or skirt, has several locking flanges so that the cap can be depressed during activation of the closure structure to cause a corresponding depression of the stopper, and hence activation of the vial, with the stopper and cap both being locked in their depressed conditions. This closure structure was developed specifically for use on vials having a neck opening which is of the same size, that is diameter, as the adjacent vial compartment, and has operated fairly satisfactorily when used with a large or wide-mouth vial of this type.

However, there still exists a need for a closure structure suitable for use on a conventional two-compartment vial of the type wherein the neck opening is substantially smaller than the adjacent compartment with which it communicates, which closure structure must be capable of efficiently sealing the neck opening while permitting efficient and simple activation of the vial when desired, while at the same time permitting control over the stopper both during and after activation.

One of the problems which has been long experienced with conventional vials of this latter type, that is vials having a neck opening smaller than the adjacent compartment, is the difficulty in retaining control over the stopper both during and after vial activation. Many of the known closure structures have been unsatisfactory in that, during activation of the vial, the stopper has a tendency to pop completely through the neck into the compartment, thereby contaminating the medication. Another difficulty with these conventional structures is the inability to easily remove all of the mixed medication with a syringe due to the protrusion of the depressed stopper part way into the adjacent compartment such that, when the vial is inverted and a syringe inserted through the stopper, a portion of the medication is isolated in the annular space surrounding the depressed stopper and hence can not be easily removed.

Accordingly, it is an object of the present invention to provide an improved closure structure specifically for use on a two-compartment vial of the type having a neck opening at one end which is of substantially smaller diameter than the adjacent compartment. The closure structure involves a cap which surrounds and permits activation of a stopper sealingly seated within the neck of the vial, whereby activation of the stopper is more uniformly achieved while at the same time the stopper and the vial contents are maintained free of contamination. The cap additionally has locking structure associated therewith such that it is fixedly connected to the vial neck when in a nonactivated condition, and is also similarly locked to the vial when in an activated position to permit secure handling of the vial, such as during insertion of a syringe through the stopper, without requiring removal of the cap. The cap, however, does permit limited slidable displacement thereof, and of the stopper, such as a limited withdrawal relative to the vial when in an activated position, to permit access to the entire vial contents. The cap is also securely locked to the stopper both before, during and after activation to insure proper control over the stopper at all times, and to positively prevent the stopper from popping into the enlarged compartment during activation.

In the vial and closure assembly of the present invention, the reduced neck end of the vial has a resilient stopper sealingly seated therein, which stopper has a lower cylindrical portion of larger diameter seated within the neck opening. The stopper also has an upper projecting portion of smaller diameter, which upper portion is surrounded by an annular groove directly adjacent the interface with the larger diameter portion. A one-piece cap surrounds the projecting portion of the stopper and is attached to the rim of the vial. The cap includes concentric inner and outer sleevelike skirts which are radially spaced apart and are joined together by a top wall. The inner skirt has slits extending axially thereof so as to function as a resilient split collet formed by a plurality of resilient fingers which project downwardly from the top wall. The inner skirt snugly surrounds the upper stopper portion and terminates, at its lower free end, in a locking flange which projects into the annular groove to axially lock the cap and stopper together. This inner skirt, when inserted over the upper stopper portion, has the individual fingers thereof suitably resiliently deformed so as to insure that the lower locking flange as associated with each finger snugly snaps into and is resiliently held within the annular groove. This inner skirt is of slightly smaller diameter than the inner diameter of the neck opening, at its free end, so that activation of the vial causes the stopper and inner skirt to be axially slidably inserted into the neck. The neck opening itself is normally of a slight converging taper so that, as the stopper and inner skirt are depressed into the neck opening, the collet defined by the inner skirt more securely grippingly engages the stopper to prevent it from popping into the adjacent compartment. The outer skirt is axially longer than the inner skirt and, at the lower end thereof, has an inner locking flange which resiliently snaps beneath the annular rim of the vial to lock the cap thereto. The outer skirt also has a second locking flange on the inner surface thereof at a location spaced upwardly from the lower edge so that, upon activation, the cap is pushed downwardly so that the vial rim moves past the second locking flange, as permitted by limited resilient deformation of the outer skirt, and snaps into position below the rim to positively lock the depressed cap to the vial. This second locking flange is spaced from the cap top wall by a distance substantially greater than the axial extent of the vial rim such that, when the cap is locked in its depressed or activated position, the cap and stopper can be axially withdrawn a limited extent relative to the vial so that the stopper does not project into the compartment, whereby the medication can be removed therefrom as by use of a syringe.

One of the objects of the improved closure structure according to this invention results from the fact that the inner skirt, namely the split collet, is axially locked to the stopper to create a secure connection therebetween. In addition, this collet is slidably inserted into the vial neck during activation, and a camming relationship exists between the collet and the vial neck so as to increase the gripping of the stopper by the collet to thereby positively axially secure the collet and stopper together, whereby the stopper is positively prevented from popping into the adjacent compartment. This cammed relationship between the collet and the vial neck may be achieved by forming the vial neck with a slight taper, or by providing the collet with a suitable taper.

Another object of this invention is an improved closure structure for a vial, as aforesaid, which due to the positive and secure locking of the stopper to the cap during activation, can be designed to provide for substantially increased stroke of the stopper during activation. In this manner, in situations where the upper compartment is considered oversized and hence contains a larger gas space in view of a smaller quantity of diluent being stored in the compartment, the closure structure can be designed to provide for increased stroke of the stopper such that the latter will project a substantial extent into the upper compartment so as to effect the desired degree of compression to cause efficient dislodgement of the constriction plug. This can be achieved while still retaining the stopper axially secured to the cap such that the stopper does not pop into the compartment.

Figure 1:
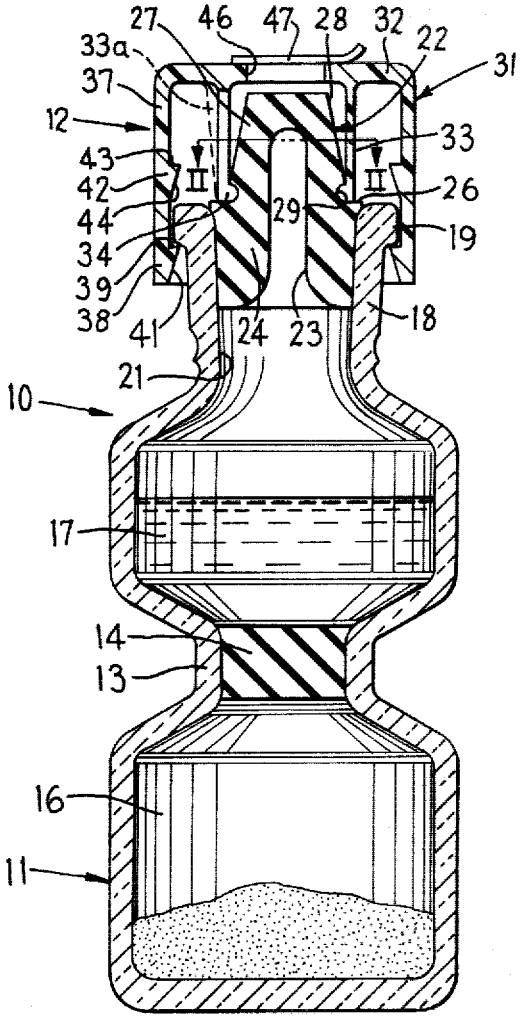
FIG. 1 is a side elevational view of a vial and closure assembly embodying the invention.

For convenience in description, the words "upper" and "lower" will have reference to the invention and parts thereof as appearing in FIG. 1. The terms "inner" and "outer", along with derivatives thereof, will have reference to directions toward and away from, respectively, the geometric center of the vial and designated parts thereof.

DETAILED DESCRIPTION

The vial assembly 10 (FIG. 1) includes a conventional two-compartment vial or container 11 which is closed at the lower end thereof, and is open at the upper end to permit filling thereof. A closure structure 12 sealingly closes the upper end of the vial to prevent contamination of the contents thereof. This closure structure, after attachment thereof to the vial, is substantially permanently connected thereto since removal of the closure structure is likely to result in destruction thereof.

The vial 11 has a constriction 13 intermediate the ends thereof, and a moisture barrier or plug 14 is sealingly seated within this constriction. This plug 14, which is inserted during the filling of the vial, sealingly divides the vial into two enlarged compartments 16 and 17. In a typical utilization of the vial assembly 10, a lyophilized medication is placed in the lower compartment 16, and a quantity of liquid solvent is stored within the upper compartment 17.

The upper end of the vial defines an open annular neck 18, the free end of which terminates in a radially outwardly extending annular flange or rim 19. This neck 18 defines an opening 21 which is in direct communication with the upper compartment 17 to permit initial filling of the vial. This opening 21 is of substantially smaller size, and specifically of smaller diameter, than the adjacent compartment 17, but is sized so as to permit the plug 14 to pass therethrough during the initial filling operation. This configuration of the vial, wherein the compartments, the constriction and the neck opening are all substantially coaxially aligned, is conventional and permits the vial to be manufactured using a glass-blowing process.

The neck opening 21 is sealingly closed by the closure structure 12 which includes a substantially cylindrical stopper 22 preferably fabricated from a resiliently flexible material impervious to the solvent contained in the upper compartment 17. The stopper 22 has a deep, downwardly opening recess 23 formed therein and communicating with the upper compartment 17 so that a needle of a conventional syringe can be inserted axially through the upper end of the stopper with relative ease.

The stopper 22 has a lower cylindrical portion 24 which is sealingly disposed within the neck opening 21. This lower stopper portion 24, when in a relaxed or uncompressed condition, has an outer diameter which is slightly greater than the diameter of the neck opening 21 so as to cause slight compression of the stopper portion 24 to insure a proper sealing and seating of the stopper within the vial neck. This lower stopper portion 24 is normally seated within the neck opening such that the upper surface or shoulder 26 of this portion is disposed substantially flush with the free end of the neck 21. The lower stopper 24 can, if desired, be provided with a plurality of spaced, annular ridges therearound so as to provide a different type of sealing engagement between the stopper and the vial.

Stopper 22 also includes an upper cylindrical portion 27 which is coaxially aligned with the lower portion 24 and protrudes outwardly beyond the vial. This upper portion 27, in the illustrated embodiment, is externally tapered so as to be of larger diameter at the end thereof where it connects to the lower cylindrical portion 24. This protruding cylindrical portion 27 also has an annular undercut groove 29 formed therein in encircling relationship thereto, which groove is disposed substantially between or at the interface between the upper and lower stopper portions, such as directly adjacent the shoulder 26.

Closure structure 12 also includes a cap member 31 which surrounds the stopper 22 and is mechanically interlocked to the vial neck 18. This cap 31 is normally constructed in one piece, such as by molding of a plastic material, such as polyethylene, so that the cap will have limited resilience and flexibility, but at the same time will still be relatively rigid.

The cap 31 includes a top wall 32 to which is secured an inner sleevelike skirt 33, commonly referred to as the activation sleeve, disposed in surrounding relationship to the upper stopper portion 27. This activation sleeve 33 has, at its lower free end, an annular locking flange 34 which extends radially inwardly so as to be engageable within the annular groove 29 to thereby mechanically interlock the cap 31 and stopper 22 together.

Figure 2:
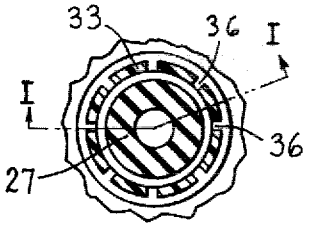
FIG. 2 is a fragmentary sectional view taken along line II—II in FIG. 1.
Figure 3:
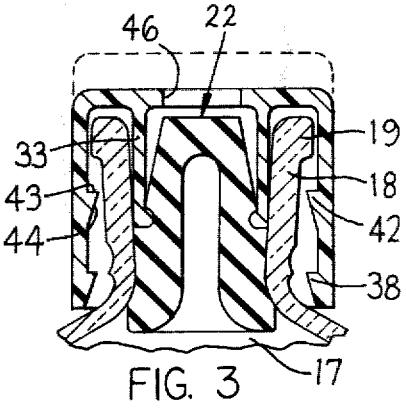
FIG. 3 is a fragmentary sectional view showing the closure structure in an activated position.

As illustrated by FIG. 2, the activation sleeve 33 has a plurality of slits 36 formed therein, which slits extend upwardly from the lower free end of the sleeve and extend axially throughout a major extent of the sleeve length, whereupon the activation sleeve 33 functions substantially as a split collet. These slits 36 result in the sleeve being formed from a plurality of substantially resilient fingers which are secured to and project downwardly from the top wall 32, with each of these fingers having a portion of the locking flange 34 associated with the lower free end thereof. This thus provides the activation sleeve 33 with substantial resiliency so that the locking flanges 34, as formed on the free ends of these fingers, can readily resiliently snap into the annular groove 29 to create a snug engagement between the sleeve 33 and the exposed portion 27 of the stopper. This activation sleeve or collet 33, when secured to the upper stopper portion 27 as illustrated in FIG. 1, has an outer diameter which is preferably slightly smaller than the diameter of the neck opening 21, at its free end, so that the skirt 33 and stopper portion 27 can thus axially move as a unit directly into the neck opening substantially as illustrated by FIG. 3.

The cap 31 also includes an outer sleevelike cylindrical skirt 37 which is concentric with but spaced radially outwardly from the inner skirt 33. This outer skirt 37 is also integrally fixed to and projects downwardly from the annular top wall 32. Outer skirt 37 is of greater axial length than the inner skirt 33.

This outer skirt 37 has a locking flange 38 associated with the lower free end thereof, which flange extends radially inwardly so as to project under the annular rim 19 to thereby mechanically lock the cap 31 beneath the rim to prevent accidental separation of the cap from the vial. This locking flange 38 has a substantially planar shoulder 39 formed on the upper end thereof so as to be positionable directly under the vial rim, and the inner surface 41 of this locking flange 38 is formed as a cam in that it diverges downwardly such that, during mounting of the cap on the vial, this inner cam surface sufficiently resiliently deforms the cap to facilitate its insertion over the rim, following which the locking flange resiliently snaps into position beneath the rim 19 substantially as illustrated by FIG. 1. This locking flange 38 is preferably formed by a plurality of individual flanges or flange segments arranged at uniformly spaced intervals around the sleeve 37 so as to facilitate the resilient deformation of the sleeve during mounting of the cap on the vial.

A second or upper locking flange 42 is integrally connected to the inner surface of the outer skirt 37 and projects radially inwardly therefrom. This upper locking flange 42, which is spaced upwardly a substantial distance from the lower locking flange 38, is of a configuration similar to the flange 38 in that it defines an upper shoulder 43 and an inner tapered camming surface 44 such that the cap can be slidably depressed relative to the vial so that the cam surface 44 will react against the annular rim 19, causing sufficient resilient deformation of the outer skirt to enable it to slide past the rim and then resiliently snap into a locking position with the flange 42 disposed below the rim, substantially as illustrated by FIG. 3. This upper locking flange 42, like the lower locking flange 38, is also preferably formed from a plurality of separate flanges or flange portions which are disposed in a circular pattern but are angularly spaced around the skirt to facilitate the resilient deformation of the latter when it is being cammed downwardly past the rim 19.

As illustrated in FIG. 3, the upper locking flange 42 is spaced downwardly from the cap top wall 32 such that the axial spacing between the top wall 32 and the shoulder 43 substantially exceeds the axial length of the vial rim 19. This thus enables the cap 31 and stopper 22 locked thereto to be axially slidably displaced through a limited extent relative to the vial, even when in the activated position as illustrated by FIG. 3. In this manner, the cap and stopper can be fully depressed into an activated position similar to that illustrated by FIG. 3, in which position the lower end of the stopper 24 may protrude at least slightly into the upper chamber 17 to effect the necessary compression required for dislodging the plug 14, following which the cap 31 and stopper 22 can then be slidably pulled upwardly relative to the vial into a position illustrated by dotted lines in FIG. 3, which position is limited by the engagement of shoulder 43 with the underside of the rim 19, so that the lower end of stopper 24 is fully retracted from the chamber 17 to facilitate removal therefrom of the entirety of the medication such as by a syringe needle inserted through the stopper.

The top wall 32 of cap 31 also has a central opening or hole 46 extending therethrough so as to provide access to the upper end of the stopper 22 when insertion of a syringe needle therethrough is desired. This access opening 46 is normally covered by a dust shield 47 which is removably secured to the top wall.

OPERATION

After the vial 11 has been suitably filled in a conventional manner, the stopper 22 is then sealingly seated within the neck opening 21, and the cap 31 is then pressed downwardly onto the vial so that the outer skirt thereof lockingly engages the rim 19, substantially as illustrated in FIG. 1. This locking of the cap to the vial also simultaneously causes the inner skirt 33 to become mechanically locked to the stopper 22 due to the resilient snapping of the flanges 34 into the groove 29. When in this assembled condition illustrated by FIG. 1, the cap is axially interlocked with the vial, and the stopper is similarly axially interlocked to the cap. Thus, the stopper can not be easily accidentally pushed downwardly into the vial independently of the cap, and the cap similarly can not be easily removed, either accidentally or deliberately, from the vial. The contents of the vial can thus be maintained in a sealed and uncontaminated condition to permit safe storage and handling thereof.

To activate the vial assembly 10, the cap 31 is pressed axially toward the opposite end of the vial, which results in the cap 31 and stopper 22 being simultaneously moved toward and into the vial in telescoping relationship therewith. Such movement of stopper 22 creates pressure within the upper compartment 17 which forces the plug 14 out of the constriction 13 so that the solvent can move into the lower compartment 16 and mix with the medication therein. During this downward or inward movement of the cap 31 toward the vial neck, the upper stopper portion 27 and the surrounding collet or sleeve 33 move axially into the vial neck until the stopper reaches the activated position illustrated in FIG. 3. During this movement toward the activated position of FIG. 3, the outer skirt 37 moves downwardly over the rim 19, past the upper locking flange 42, so that the flange 42 snaps into position below the rim 19 to thereby lock the cap 31, and hence the stopper 22, in this activated position.

During movement of the closure structure into the activated position of FIG. 3, as the stopper 22 and collet 33 move axially into the neck opening, the tapered converging configuration of the neck opening 21 causes a gradually increased deflection of the collet 33, and hence a gradually increased compression of the stopper 22, so that the stopper thus becomes more securely held within the neck opening, and more securely interconnected to the cap 31 to prevent the stopper from popping into the compartment 17, such as when a pushing force is imposed on the stopper due to insertion of a needle therethrough. While this increased compression and holding of the stopper is achieved by the tapered configuration of the neck opening 21, it will be appreciated that this same effect could be achieved by forming the neck opening 21 of uniform diameter and by providing a suitable tapered exterior surface on the resilient fingers associated with the collet 33, such as by making these fingers with a tapered configuration indicated by dotted lines in FIG. 1, as designated 33*a*.

Once the closure structure has been activated as illustrated by FIG. 3, the dust shield 47 can be removed and the syringe needle inserted through the stopper 22 for communication with the recess 23, thereby enabling removal of the mixed medication while holding the vial assembly in an inverted position. After the medication has been removed, the stopper and cap remain locked to the vial, and hence require disposal of the vial assembly so as to prevent any attempt to reuse same.

Figure 4:
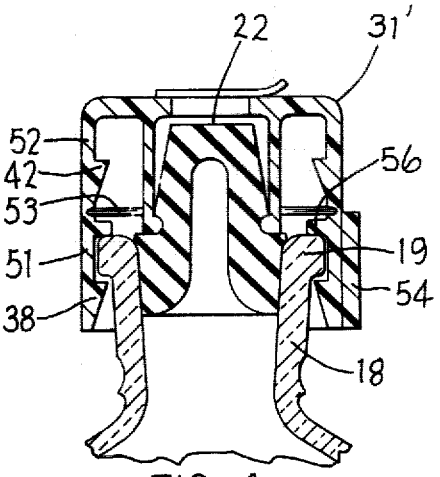
FIG. 4 is a fragmentary sectional view illustrating a variation of the closure structure.

Referring now to FIG. 4, there is illustrated a variation of the closure structure, in which variation the same stopper 22 is utilized, although a modified cap 31' is used in conjunction therewith. This cap 31' is identical to the cap 31 described above except that the upper locking flange 42 and lower locking flange 38 are respectively associated with upper and lower outer skirt portions 52 and 51, respectively. These skirt portions 51 and 52 are integrally joined and hence are fully equivalent to the skirt 37 described above, except that these skirt portions 51 and 52 are provided with a fracture line 53 disposed therebetween and extending annularly around the skirt, this fracture line 53 being effectively formed as an undercut annular groove. In this manner, the lower annular portion 51, and the locking flange 38 associated therewith, can be effectively severed from the cap 31' when activation of the closure structure is desired. To permit severing of the lower skirt portion 51, same is provided with a suitable tab 54.

This lower skirt portion 51 also has an abutment flange 56 formed integrally therewith and projecting radially inwardly so as to overlap the exposed axial end surface of the rim 19. This abutment flange 56 is disposed axially between the tapered locking flanges 38 and 42, so that the rim 19 is thus axially confined between the flanges 38 and 56 to maintain the vial assembly in its nonactivated condition. This flange 56 positively prevents activation of the vial without first severing the lower skirt portion 51 from the remainder of the cap 31'. After this severing of the lower skirt portion 51, then the closure structure is activated in the same manner described above relative to the FIG. 1 embodiment.

In the present invention, it is conventional to form the vial 11 utilizing a glass-blowing process. While the vial could be formed from tubular glass stock, nevertheless such a forming technique is substantially more expensive, and hence it is conventional to blow form the vial in view of the greater cost economics. This blow forming technique, however, obviously provides much less control over the final size and shape of the vial, and hence results in a substantially wider tolerance range as regards the resulting dimensions of the vial. This makes control over the stopper 22, when sealingly seated prior to activation, and both during and after activation, even more difficult, and hence the problem of the stopper popping into the upper compartment has been a significant one. In the present invention, however, the provision of the mechanical interlock between the collet and the upper stopper portion, coupled with the cammed relationship between the collet and the vial neck during activation, thus effectively compensates for the tolerance variations by enabling secure gripping and clamping of the stopper during and after activation, whereby popping of the stopper into the upper compartment is effectively prevented.

Although a particular preferred embodiment of the invention has been disclosed in detail for illustrative purposes, it will be recognized that variations or modifications of the disclosed apparatus, including the rearrangement of parts, lie within the scope of the present invention.

The embodiments of the invention in which an exclusive property or privilege is claimed are defined as follows:

1. In combination, a two-compartment mixing vial having a constriction disposed between the two compartments, a removable plug disposed within the constriction to provide a liquid-tight barrier between the two compartments, said vial having a neck at one end thereof for defining an opening therethrough in direct communication with one of said compartments, said opening having a cross section which is substantially smaller than the cross section of said one compartment, and a closure structure attached to said neck for sealingly closing the opening therein, said closure structure including a substantially cylindrical and resiliently flexible stopper means including a first portion having an outside diameter which is normally slightly larger than the inside diameter of, and sealingly received within, said neck opening, said stopper means including a second portion of reduced diameter projecting beyond the free end of said neck, said closure structure also including cap means having a top wall and a cylindrical skirt fixed to said top wall and projecting therefrom in surrounding relationship to said stopper, said skirt being externally telescoped over said neck, the improvement comprising:

means defining a surrounding annular groove in said stopper means in surrounding relationship to said second portion adjacent the interface thereof with said first portion;

said cap means including an inner sleeve affixed to said top wall in concentric relationship with and spaced radially inwardly from said outer skirt, said inner skirt surrounding said second stopper portion and having an outside diameter adjacent at least the free end thereof no greater than the inside diameter of the neck opening so that the inner skirt can be moved axially into the neck opening along with the second stopper portion upon urging of said closure structure toward said vial, said inner skirt having radially inwardly projecting locking means disposed thereon adjacent the free end thereof and extending into said annular groove to axially mechanically interlock said stopper means and said cap means, said inner skirt having a plurality of slits formed therein and extending axially from the free end thereof, said slits dividing said inner skirt into a plurality of elongated resilient fingers so that the inner skirt effectively functions as a split collet, and one of said inner skirt and neck opening being of a converging tapered configuration as it extends axially from the outer end toward the inner end thereof to cam the resilient fingers of the inner sleeve radially inwardly as the sleeve and stopper are progressively moved axially into the neck opening to cause more secure gripping of the stopper means by the inner sleeve.

2. A combination according to claim 1, wherein the vial has a radially outwardly projecting annular rim formed thereon adjacent the free end of said neck, and wherein said outer skirt has locking means projecting radially inwardly thereof at a location spaced downwardly from the top wall, said locking means being normally positionable above the rim when the closure structure is in a nonactivated position, said locking means being cammable past the vial rim and resiliently snappable into a locking position beneath the vial rim when the closure structure is activated.

3. A combination according to claim 1, wherein the vial has a radially outwardly projecting rim associated with and extending around the neck adjacent the free end thereof, wherein the outer skirt projects downwardly past and surrounds said rim when the closure structure is in a nonactivated position, said outer skirt having first locking flange means associated therewith and projecting radially inwardly thereof adjacent the free edge of the outer skirt, said first locking flange means extending beneath said annular rim for mechanically locking said cap means to said vial, said outer skirt having second locking flange means formed thereon and extending radially thereof at a location disposed axially between said top wall and said first locking flange means, whereby axial displacement of the cap means toward the vial so as to activate the latter causes said second locking flange means to move past said annular rim and then resiliently snap into a locking position disposed below said rim to axially mechanically lock said cap means to said vial in said activated position.

4. A combination according to claim 3, wherein the outer skirt includes first and second annular portions which are integrally joined together and which have said first and second locking flange means respectively associated therewith, said outer skirt having means defining an annular encircling fracture line between said first and second annular portions for permitting said first annular portion to be severed from the cap means prior to displacement of the latter into its activated position.

5. A combination according to claim 4, wherein the first annular portion has a radially inwardly projecting abutment formed thereon and disposed to overlie the free end of the vial neck when the cap means is in said nonactivated position, said abutment preventing activation of said cap means except when said first annular portion is separated from the remainder of said cap means.

6. A combination according to any one of claims 1–3, wherein the cam coacting between the inner skirt and the neck opening is formed by providing the neck opening with a converging tapered configuration as it extends axially inwardly toward said one compartment.

7. A combination according to claim 1, wherein the second stopper portion is of a converging tapered configuration as it projects from its inner end adjacent said groove to its axially outer free end.

8. In combination, a two-compartment mixing vial having a constriction between the two compartments, a removable plug disposed within the constriction to provide a liquid-tight barrier between the two compartments, said vial having a neck at one end thereof for defining therethrough an opening in direct communication with one of said compartments, said opening having a diameter substantially smaller than the diameter of said one compartment, said neck having an annular radially outwardly projecting rim adjacent the free end thereof, and a closure structure attached to said neck for closing the opening therein, said closure structure including a substantially cylindrical and resiliently flexible stopper means having a first portion provided with an outside diameter which is normally slightly larger than the inside diameter of, and sealingly received within, said neck opening, said stopper means also having a second portion of reduced diameter projecting beyond the free end of said neck, said first stopper portion defining an outwardly facing end surface at the interface thereof with said second stopper portion, said closure structure also including a one-piece cap mechanically connected to said vial for controlling activation of said stopper means, said one-piece cap having an annular end wall disposed so as to overlie the axial free end of said rim, said cap also including an outer sleeve-like skirt fixed to said annular end wall adjacent the outer edge thereof and projecting axially thereaway toward the neck of said vial, said outer skirt being sized so as to telescope over the vial neck, said outer skirt having locking means associated therewith and projecting radially inwardly therefrom for copperating with the rim on the neck to axially mechanically interlock the cap to said vial, the improvement comprising:

means defining a surrounding annular groove in the second portion of said stopper means in close proximity to the exposed end surface of said first stopper portion, said cap including sleevelike collet means positioned concentric with and radially inwardly of said outer skirt, said sleevelike collet means being formed by a plurality of axially elongated resilient portions which are disposed in a circular array, at least some of said elongated resilient portions having radially inwardly projecting locking flanges associated therewith, said sleevelike collet means being positioned in surrounding relationship to said second stopper portion so that said locking flanges project into said annular groove to mechanically axially lock said stopper means and said cap together, said sleevelike collet means having an outer diameter adjacent at least the inner end thereof which is no greater than the diameter of the neck opening at its free end so that the collet means and said second stopper portion can be axially pushed into the neck opening upon urging of the closure structure toward the vial, said neck and said collet means having cam means cooperating therebetween for causing the elongated resilient portions to be radially deflected inwardly to cause increased gripping and radial compression of the stopper means as the stopper means and collet means are urged axially into the neck opening.

9. A combination according to claim 8, wherein the elongated resilient portions are cantilevered from the outer ends thereof when the collet means is urged into the neck opening.

10. A combination according to claim 3, wherein said second locking flange means is axially spaced from said top wall by a distance which substantially exceeds the axial dimension of said vial rim so that the closure structure, when activated, can be axially depressed so that the vial rim moves into a position directly adjacent the top wall of the cap so that the second stopper portion projects into said one compartment, with said closure structure then being axially slidable outwardly of the vial a limited axial extent so as to cause the vial rim to be positioned directly above said second locking flange means, whereby the second stopper portion is then effectively positioned totally within said neck.

11. In combination, a two-compartment mixing vial having a constriction between the two compartments, a removable plug disposed within the constriction to provide a liquid-tight barrier between the two compartments, said vial having an elongated neck at one end thereof for defining therethrough an elongated opening in direct communication with one of said compartments, said opening having a diameter substantially smaller than the diameter of said one compartment, said neck having radially outwardly projecting means adjacent the free end thereof, and a closure structure attached to said neck for sealingly closing the opening therein, said closure structure including a substantially cylindrical and resiliently flexible stopper means having a first portion provided with an outside diameter which is normally slightly larger than the inside diameter of, and sealingly received within, said neck opening, said stopper means also having a second portion of reduced diameter projecting beyond the free end of said neck, said closure structure also including a one-piece cap mechanically connected to said vial for controlling activation of said stopper means, said one-piece cap having an end wall and an outer sleevelike skirt fixed to said end wall adjacent the outer edge thereof and projecting axially thereaway toward the neck of said vial, said outer skirt being sized so as to telescope over the vial neck, said outer skirt having locking means associated therewith and projecting radially inwardly therefrom for cooperating with the projecting means on the neck to axially mechanically interlock the cap to said vial, comprising the improvement wherein:

said cap includes collet means positioned concentric with and radially inwardly of said outer skirt, said collet means being formed by a plurality of axially elongated resilient portions which are disposed in a circular array, at least some of said elongated resilient portions having radially inwardly projecting locking flanges associated therewith, said collet means being positioned in surrounding relationship to said second stopper portion so that said locking flanges mechanically axially lock said stopper means and said cap together, said collet means having an outer diameter adjacent at least the inner end thereof which is no greater than the diameter of the neck opening at its free end so that the collet means and said second stopper portion can be axially pushed into the neck opening upon urging of the closure structure toward the vial, said neck and said collet means having cam means cooperating therebetween for causing the elongated resilient portions to be radially deflected inwardly to cause increased gripping and radial compression of the stopper means as the stopper means and collet means are urged axially into the neck opening.

* * * * *